US007756427B2

(12) United States Patent
Hanano et al.

(10) Patent No.: US 7,756,427 B2
(45) Date of Patent: Jul. 13, 2010

(54) IMAGE FORMING SYSTEM, IMAGE FORMING APPARATUS AND METHOD FOR SETTING PRINTING FUNCTION WITH TONER CONTAINER HAVING INFORMATION PROVIDING SECTION THAT STORES INFORMATION ABOUT THE QUALITY OF TONER IN THE CONTAINER

(75) Inventors: Hiroyuki Hanano, Osaka (JP); Toru Yasui, Osaka (JP); Tetsuji Yamaguchi, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 11/969,512

(22) Filed: Jan. 4, 2008

(65) Prior Publication Data

US 2008/0166138 A1 Jul. 10, 2008

(30) Foreign Application Priority Data

Jan. 10, 2007 (JP) ..... 2007-002583

(51) Int. Cl.
*G03G 15/00* (2006.01)

(52) U.S. Cl. ..... 399/12

(58) Field of Classification Search ..... 399/12, 399/27, 46, 82; 347/19
See application file for complete search history.

(56) References Cited

U.S. PATENT DOCUMENTS 6,158,837 A * 12/2000 Hilton et al. ..... 347/19
7,280,772 B2 * 10/2007 Adkins et al. ..... 399/12
7,430,379 B2 * 9/2008 Lee ..... 399/12
2005/0254838 A1 11/2005 Takahashi
2005/0260002 A1 * 11/2005 Masui ..... 399/12
2006/0216046 A1 * 9/2006 Hatakeyama ..... 399/27
2008/0118253 A1 * 5/2008 Abe ..... 399/12

FOREIGN PATENT DOCUMENTS

CN 1700105 11/2005
JP 2004-93693 3/2004
JP 2004-299332 10/2004
JP 2005-134797 5/2005
JP 2005-189686 7/2005
JP 2006227293 A * 8/2006

OTHER PUBLICATIONS

Computer Translation of JP2006-227293A.*

* cited by examiner

*Primary Examiner*—Quana M Grainger
(74) *Attorney, Agent, or Firm*—Gerald E. Hespos; Michael J. Porco

(57) ABSTRACT

Disclosed is an image forming system, which comprises an image forming apparatus, and a toner container mountable to the image forming apparatus. The image forming apparatus includes a control section, and an information acquisition section which acquires the toner-quality information about a toner container which is demountably mounted thereto. The control section is operable, based on the toner-quality information acquired by the information acquisition section, to identify the quality of the toner contained in the toner container and set a printing function based on the identified toner quality.

8 Claims, 8 Drawing Sheets

IMAGE FORMING SYSTEM, IMAGE FORMING APPARATUS AND METHOD FOR SETTING PRINTING FUNCTION WITH TONER CONTAINER HAVING INFORMATION PROVIDING SECTION THAT STORES INFORMATION ABOUT THE QUALITY OF TONER IN THE CONTAINER

BACKGROUND OF THE INVENTION

1. Field of the Invention

The present invention relates to an image forming system which comprises an image forming apparatus and a toner container adapted to be demountably mounted to the image forming apparatus, an image forming apparatus for use in the image forming system, and method for setting a printing function for the image forming system.

2. Description of the Related Art

Generally, an image forming apparatus using toner for a recording member (e.g., a paper, a plastic sheet, a cloth or an OHP sheet), such as a copy machine, a facsimile machine, a printer or a complex machine having a combination of their functions, is designed to transfer a toner image formed on a photosensitive member, onto the recording member, and subject the recording member carrying the toner image thereon to a fixing process based on a fixing unit to form an image on the recording member.

In order to supply toner onto the photosensitive member, a development roller of a development unit is disposed in a development region of the photosensitive member so as to supply toner from a detachable toner container (toner cartridge) through the use of agitating means and charging means.

Therefore, the image forming apparatus using the toner container involves a need for replacing the toner container with a new one when toner therein has run out.

The toner container includes one type designed to serve as a developer tank while being mounted to the image forming apparatus, and another type designed to be temporarily mounted to the image forming apparatus and then demounted therefrom just after toner has completely replenished from the toner container into a developer tank provided in the image forming apparatus. The toner container demounted from the image forming apparatus after completion of the toner replenishment will be collected by a recycling dealer or the like, and reused after being refilled with toner.

Heretofore, there has been provided an image forming system comprising an ink cartridge equipped with a wireless tag, and a compatibility diagnostic device adapted to identify a type of ink cartridge based on information from the wireless tag. The image forming system is operable, when the ink cartridge is diagnosed with incompatibility as a result of the identification by the compatibility diagnostic device, to restrict an ink-cartridge replacement operation (e.g., generate alarm sound).

There has also been provided an image forming system comprising a toner cartridge equipped with an IC tag, and an image forming apparatus operable, when the toner cartridge is mounted on a mounting section, and a toner color corresponding to the mounting section is not identical to a toner color indicated by the IC tag of the toner cartridge, to inhibit a printing operation.

Heretofore, in the image forming apparatus designed to transfer a toner image formed on a photosensitive member, onto a recording member, and subject the recording member carrying the toner image thereon to a fixing process based on a fixing unit to form an image on the recording member, a toner container mountable to a specific type of image forming apparatus has been limited to a single specific type, in view of using an appropriate type of toner for the specific type of image forming apparatus. Thus, in the recycle process of collecting and reusing a used toner container, if the specific type of toner container is refilled with a different type of toner, and reused, quality of the toner is likely to exert an influence on a printing result to cause a problem about a change in image quality.

SUMMARY OF THE INVENTION

According to one aspect of the present invention, there is provided an image forming system which comprises an image forming apparatus, and a toner container mountable to the image forming apparatus. The toner container includes an information providing section which provides toner-quality information indicative of quality of a toner contained in the toner container, to the image forming apparatus. The image forming apparatus includes: a toner-container mounting section which allows the toner container to be demountably mounted thereon; an information acquisition section which acquires the toner-quality information about the toner contained in the toner container, from the information providing section of the toner container mounted on the toner-container mounting section; a printing-data producing section which produces printing data; and a control section which controls respective operations of the information acquisition section and the printing-data producing section. The control section is operable, based on the toner-quality information acquired by the information acquisition section, to identify the quality of the toner contained in the toner container and set a printing function based on the identified toner quality, to the printing-data producing section.

In the image forming system of the present invention, quality of a toner contained in the toner container can be identified to set a printing function based on the identified toner quality. This makes it possible to adequately perform a printing job depending on the identified toner quality.

These and other objects, features and advantages of the present invention will become more apparent upon reading of the following detailed description along with the accompanied drawings.

DETAILED DESCRIPTION OF THE PREFERRED EMBODIMENTS

With reference to the drawings, the present invention will now be specifically described based on an embodiment thereof. In the following description about FIGS, identical or similar elements and components are defined by the same or similar reference codes, and the description of the same or similar elements and components will be omitted.

First Embodiment

Figure 1:
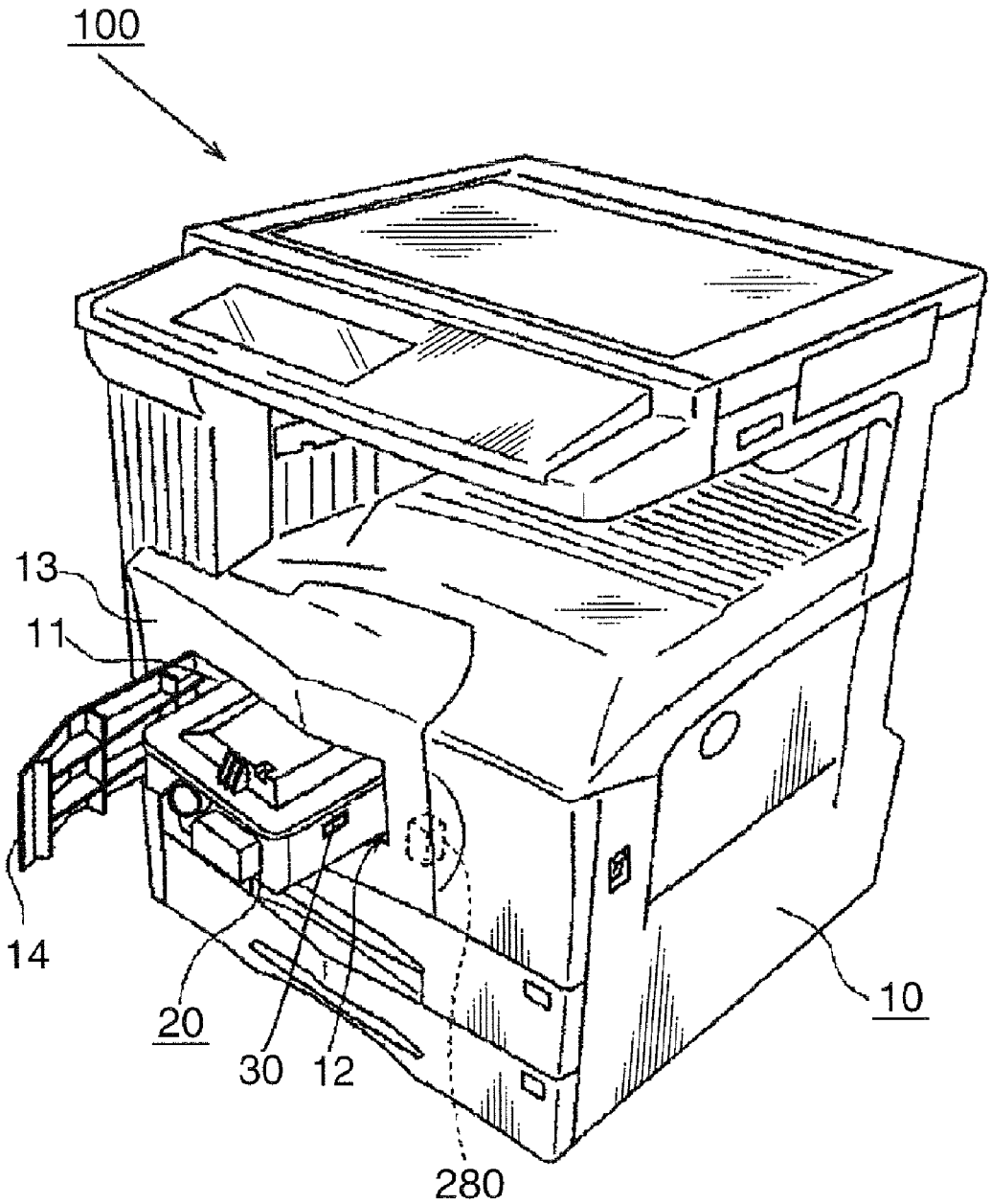
FIG. 1 is an external perspective view showing an image forming system according to a first embodiment of the present invention.

The present invention is applied to an image forming system comprising an image forming apparatus, and a toner container adapted to be demountably mounted to the image forming apparatus, as shown, for example, in FIG. 1. FIG. 1 is an external perspective view showing an image forming system 100 according to a first embodiment of the present invention.

As shown in FIG. 1, in the image forming system 100 according to the first embodiment, an image forming apparatus 10 comprises a toner-container mounting section 11 adapted to allow a toner container 20 to be demountably mounted thereon, a toner-container insertion/ejection opening 12 provided in an exterior cover 13, and a door 14 provided to the exterior cover 13 so as to selectively open and close the toner-container insertion/ejection opening 12.

Figure 2:
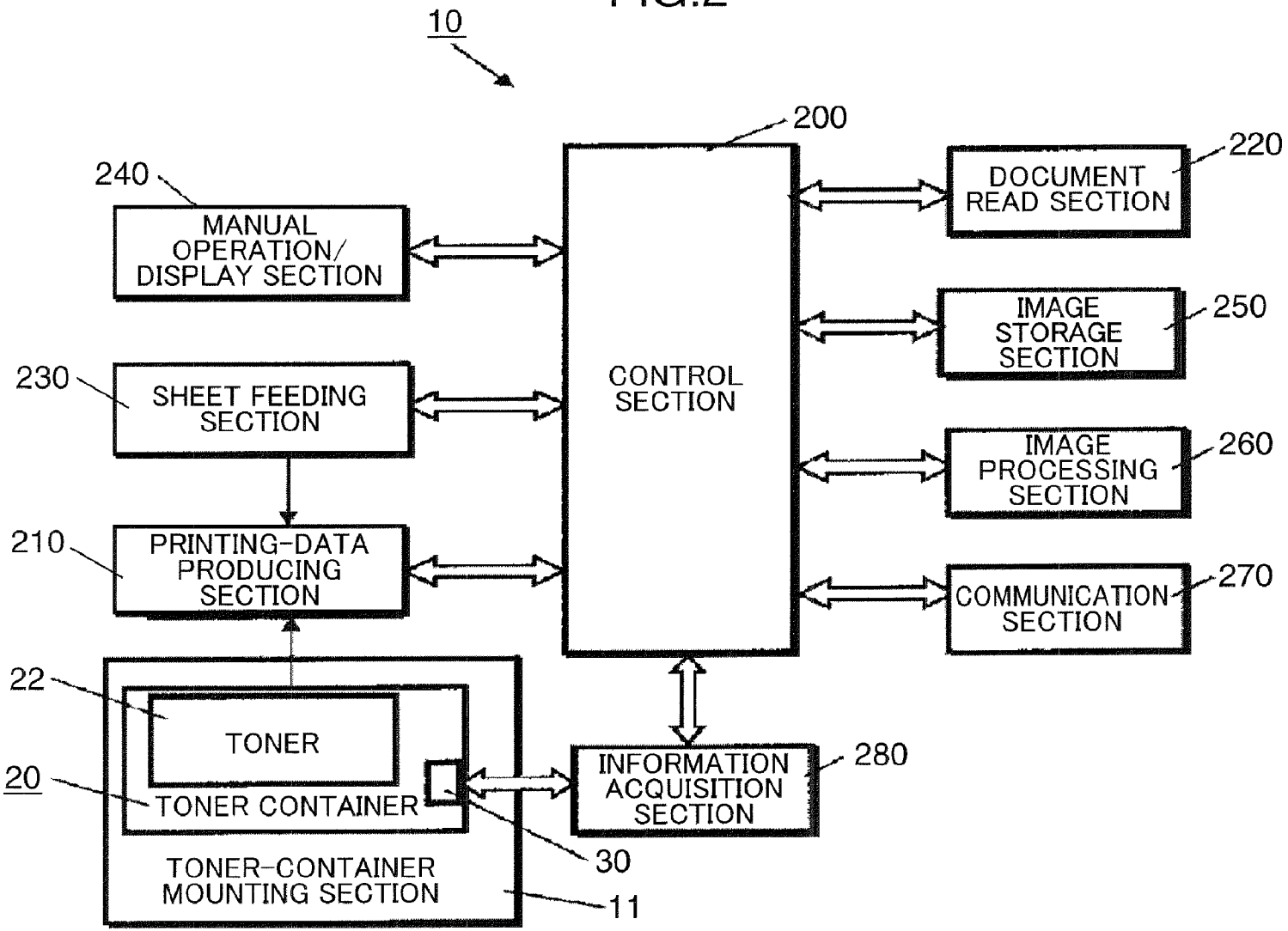
FIG. 2 is a block diagram showing a system configuration of an image forming apparatus.

The image forming apparatus 10 consists of a so-called complex machine having copying, printing, scanning and facsimile-transmitting/receiving functions, and has the following system configuration. FIG. 2 is a block diagram showing a system configuration of the image forming apparatus 10. As shown in FIG. 2, the image forming apparatus 10 has a system configuration comprising a control section 200, a printing-data producing section 210, a document read section 220, a sheet feeding section 230, a manual operation/display section 240, an image storage section 250, an image processing section 260, a communication section 270, and an information acquisition section 280. The control section 200 is made up of a CPC and various memories, and adapted to generally govern an operational control of the image forming apparatus. Specifically, each of the printing-data producing section 210, the document read section 220, the sheet feeding section 230, the manual operation/display section 240, the image storage section 250, the image processing section 260, the communication section 270 and the information acquisition section 280 is electrically connected to the control section 200, and the control section 200 is operable to control respective operations of these sections. The information acquisition section 280 is adapted to perform information exchange with an information providing section 30 of the toner container 20 in a state of being mounted on the toner-container mounting section 11. For example, the information acquisition section 280 can receive information from the information providing section 30 so as to acquire information indicative of quality of a toner 22 contained in the toner container 20, through analysis of the received data.

Figure 3:
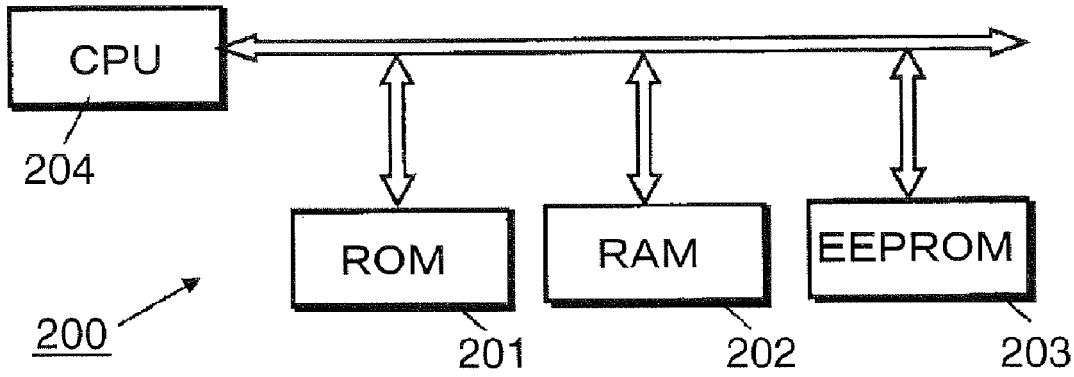
FIG. 3 is a block diagram showing the configuration of a control section.

FIG. 3 is a block diagram showing the configuration of the control section 200. As shown in FIG. 3, the control section 200 includes a ROM (Read Only Memory) 201 storing therein a control program for the image forming apparatus 10, a RAM (Random Access Memory) 202 adapted to temporarily store data therein, an EEPROM (Electrically Erasable Programmable ROM) 203 storing therein various updatable setting data, and a microcomputer (CPU) 204 adapted to execute a program, such as the control program read from the ROM 201, which are electrically connected to each other, for example, via a communication bus. The control section 200 is operable to generally control the image forming apparatus 10, based on information about a specific instruction input from the manual operation/display section 240 and other input section, and detection signals from various sensors disposed at required positions of the image forming apparatus 10.

The printing-data producing section 210 is provided as a means to produce printing data and form (print) a certain image onto a sheet transported by the sheet feeding section 230, based on the printing data. Although not illustrated, the printing-data producing section 210 includes a printer controller, a laser scanning unit adapted to scan a photosensitive drum with a laser beam so as to form an electrostatic latent image having a lowered charge level, and a development unit adapted to attach toner onto the electrostatic latent image on the photosensitive drum so as to form a toner image.

The document read section 220 is provided as a means to optically read a document, and create image data corresponding to the document. Although not illustrated, the document read section 220 includes a contact glass, and a scanner equipped with a CCD (Charge Coupled Device) sensor which creates the image data from the optical acquired document image, an exposure lamp and others. Specifically, the document read section 220 is operable to scan a document placed on the contact glass so as to acquire image data about the document, and output the image data to the control section 200.

The sheet feeding section 230 is provided as a means to feed a sheet to the printing-data producing section 210.

The manual operation/display section 240 is provided as a means to allowing a specific instruction to be input therethrough according to a user's manual operation. Although not illustrated, the manual operation/display section 240 includes a liquid crystal display (LCD) adapted to display a plurality of keys for allowing a user to input an instruction for execution of printing, a number of printed sheets and others, and various operation buttons for displaying manual-operation guide information for manually inputting various setting parameters of copying operations and others.

The image storage section 250 serves as a memory adapted to temporarily store image data read by the document read section 220 and image data transmitted from an external apparatus through the communication section 270.

The image processing section 260 is provided as a means to subject printing data to various image processings, such as a processing of converting printing data to RGB data or CMYK data, and a processing of grouping a plurality of document images together in a single sheet, i.e., a combination of a scaling processing of enlarging or reducing an image size of a document image and a layout processing of arranging a plurality of document images in a single sheet.

The communication section 270 is made up of a LAN card or a network interface, to serve as a means to allow the image forming apparatus 10 to be connected to an outside apparatus via a network or the like.

The information acquisition section 280 is operable to receive and analyze information provided from the information providing section 30 of the toner container 20 in a state of being mounted on the toner-container mounting section 11, so as to acquire information indicative of quality of a toner 22 contained in the toner container 20. The information acquisition section 280 has a communication function capable of performing information exchange with the information providing section 30 to receive information from the information providing section 30 of the toner container 20. This communication function may be a wireless type or may be a wired type.

Figure 4:
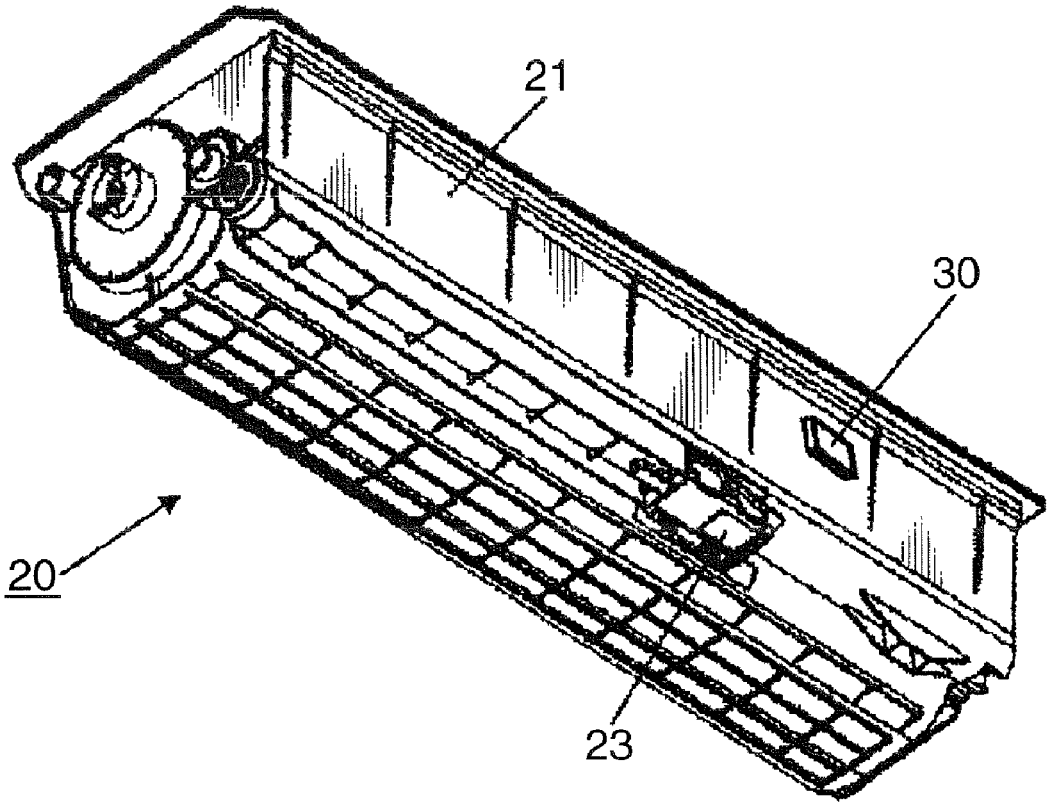
FIG. 4 is a perspective view showing a toner container when viewed from the side of a bottom thereof.

FIG. 4 is a perspective view showing the toner container 20 when viewed from the side of a bottom thereof. As shown in FIG. 4, in the image forming system 100, the toner container 20 comprises a casing 21, i.e., a body of the toner container 20, a toner supply port 23 for supplying the toner 22 reserved in the casing 21 to outside, and the information providing section 30. The casing 21 is formed to have an outer shape capable of being demountably mounted on the toner-container mounting section 11 of the image forming apparatus 10, and an internal space capable of reserving the toner 22 therein. When the toner container 20 is mounted on the toner-container mounting section 11 of the image forming apparatus 10, the toner 22 is supplied from the toner supply port 23 provided in a bottom wall of the casing 21, to the development unit of the printing-data producing section 210 of the image forming apparatus 10. The information providing section 30 is adapted to provide information indicative of quality of the toner 22 contained in the toner container 20, and disposed on an outer surface of a lateral wall of the casing 21. It is understood that a position of the information providing section 30 is not limited to the lateral wall of the casing 21 as shown in FIG. 4. What matters is that the information providing section 30 is disposed to ensure the communication with the information acquisition section 280 of the image forming apparatus 10, without hindering the toner container 20 from being demountably mounted to the image forming apparatus 10.

Figure 5:
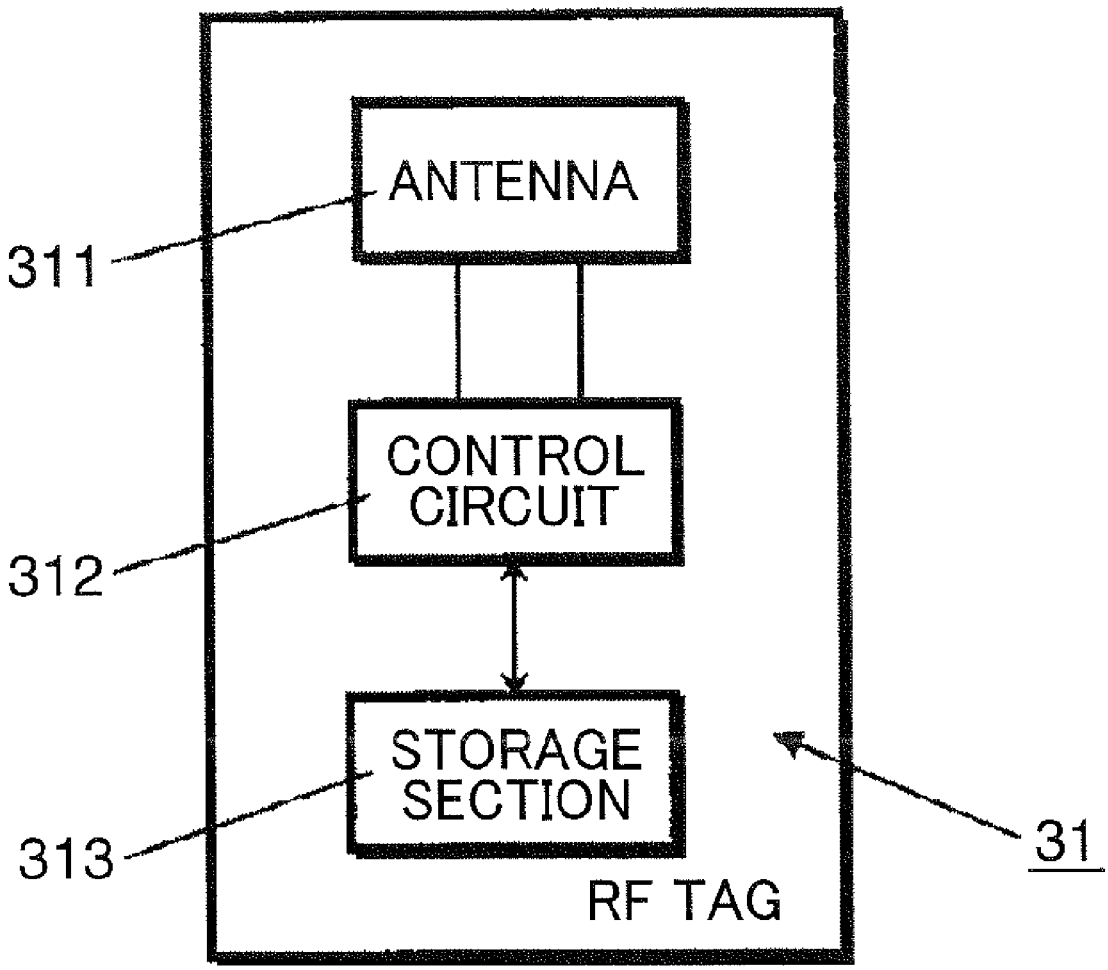
FIG. 5 is a block diagram showing a schematic configuration of a radio frequency identification (RFID) tag.

For example, the information providing section 30 may be made up of a radio frequency identification (RFID) tag 32 having a configuration as shown in FIG. 5. FIG. 5 is a block diagram showing a schematic configuration of the RFID tag 31 used as the information providing section 30. As shown in FIG. 5, the RFID tag 31 comprises an antenna 311, a control circuit 312, and a storage section 313. The control circuit 312 is adapted to wirelessly communicate with outside using the antenna 311. The storage section 313 stores therein at least the toner-quality information indicative of the quality of the toner 22, and a tag ID indicative of a fact that the container 20 is a qualified component.

In cases where the RFID tag 31 is used as the information providing section 30 of the toner container 20, the information acquisition section 280 of the image forming apparatus 10 may be made up of a reader/writer adapted to access the storage section 313 of the RFID tag 31 and read/write information from/into the storage section 313. For example, the information acquisition section 280 may comprise a communication circuit and an antenna (not shown) which allow for information exchange with the antenna 311 of the RFID tag 31. In this case, based on the above communication circuit and antenna, the information acquisition section 280 is operable to transmit/receive a read/write execution signal for executing read/write of information from/into the storage section 313 of the RFID tag 31 so as to read information stored the storage section 313 and write information into the storage section 313, in a wireless manner.

In an operation of receiving information transmitted from the information acquisition section 280 of the image forming apparatus 10, the RFID tag 31 can operate using a resonantly-generated electric power as a power source. Specifically, the RFID tag 31 is a passive type where there is no need to have a built-in battery. That is, the RFID tag 31 can be used semi-permanently while facilitating reduction in size/thickness. Thus, the use of the passive-type RFID tag 31 is desirable in view of reuse of the toner container 20. The control circuit 312 is operable to receive information transmitted from the information acquisition section 280 of the image forming apparatus 10 through the antenna 311, and responsively read information to be transmitted to the information acquisition section 280 from the storage section 313 to transmit the read information to the information acquisition section 280 through the antenna 311.

In this manner, the information stored in the storage section 313 of the RFID tag 31 of the toner container 20 in the state of being mounted on the toner-container mounting section 11 is transmitted to and received by the information acquisition section 280 of the image forming apparatus 10, and the information acquisition section 280 will analyze the received information to acquire toner-quality information indicative of quality of the toner 22 contained in the toner container 20 mounted on the toner-container mounting section 11.

Figure 6:
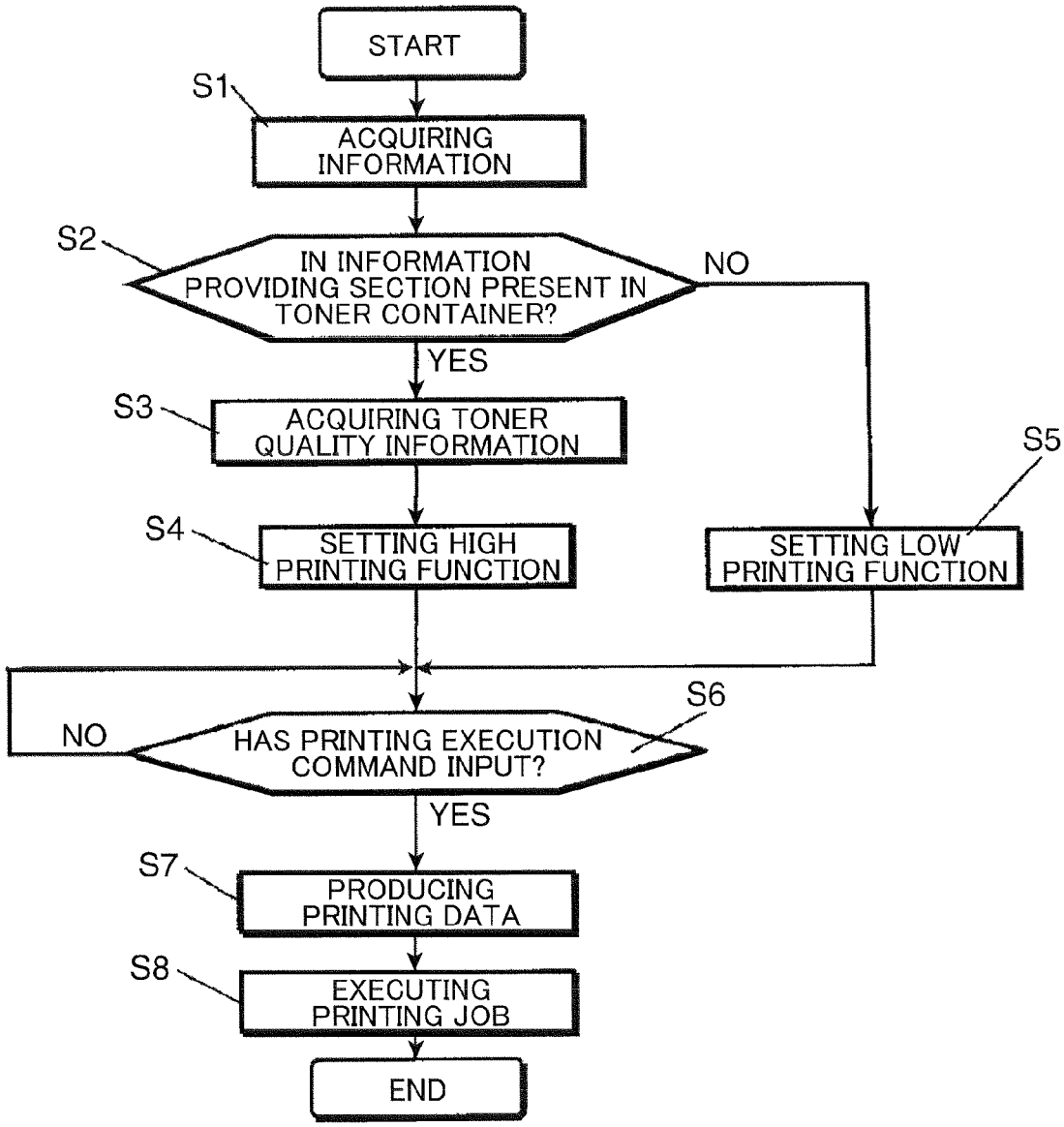
FIG. 6 is a flowchart showing a process of a printing job to be executed under control of the control section.

In the image forming system 100 having the above configuration, the control section 200 of the image forming apparatus 10 is operable to control a printing job according to a process as shown in FIG. 6. FIG. 6 is a flowchart showing a process of a printing job to be executed under control of the control section 200. The following description will be made on the assumption that the RFID tag 31 is used as the information providing section 30 of the toner container 20.

Upon turn-on of power, the control section 200 of the image forming apparatus 10 starts a control operation to firstly instruct the information acquisition section 280 to perform an image acquisition processing (Step S1), and determine whether the RFID tag 31 is present in the toner container 20 in a state of being demountably mounted on the toner-container mounting section 11 (Step S2). For example, in Steps S1 and S2, the information acquisition section 280 transmits the read/write execution signal to the toner container 20 in a state of being mounted on the toner-container mounting section 11. When the RFID tag 31 is present in the toner container 20, the read/write execution signal transmitted from the information acquisition section 280 is received by the RFID tag 31. Then, the RFID tag 31 transmits a receipt acknowledgement signal to the information acquisition section 280, and the information acquisition section 280 recognizes a presence of the RFID tag 31 based on receiving the receipt acknowledgement signal. If the RFID tag 31 is not present in the toner container 20, the information acquisition section 280 will never receive the receipt acknowledgement signal, and thereby can recognize an absence of the RFID tag 31. In this manner, the information acquisition section 280 can determine whether the RFID tag 31 is present or absent in the toner container 20.

In this process, the RFID tag 31 may be configured to transmit the information stored in the storage section 313 just after receipt of the read/write execution signal, without transmitting the receipt acknowledgement signal. In this case, the information acquisition section 280 may be configured to determine the presence or absence of the RFID tag 31, based on whether requested information is received from the toner container 20 after transmission of the read/write execution signal.

Due to occurrence of defects in communication between the information acquisition section 280 and the RFID tag 31, the information acquisition section 280 is likely to be precluded from recognizing the presence of the RFID tag 31, even if the RFID tag 31 is present in the toner container 20. In this case, the information acquisition section 280 may determine the absence of the RFID tag 31, without acquiring toner-quality information from the RFID tag 31.

Then, if the determination in Step 2 is "YES", i.e., it is determined that the RFID tag 31 is present in the toner container 20, the control section 200 will receive the information stored in the storage section 313 of the RFID tag 31 to analyze the received information so as to acquire toner-quality information indicative of quality of the toner 22 contained in the toner container 20 in the state of being mounted on the toner-container mounting section 11 (Step S3).

Then, the control section 200 identifies quality of the toner 22 based on the toner-quality information acquired by the information acquisition section 280 in Step S3, and sets an appropriate printing function to the printing-data producing section 210 (Step S4). For example, in Step S4, the control section 200 sets a relatively high printing function to the printing-data producing section 210.

Differently, if the determination in Step 2 is "NO", i.e., it is determined that the RFID tag 31 is absent in the toner container 20, or the information acquisition section 280 cannot acquire requested information from the toner container 20, the control section 200 will set a relatively low printing function which allows image quality to be not affected by quality of the toner 22, to the printing-data producing section 210 (Step S5).

After setting a printing function to the printing-data producing section 210 in Step S4 or S5, the control section 200 will be kept in a standby state until a printing execution command is input (Step S6). Upon input of the printing execution command through a manual operation to the manual operation/display section 240 or through the communication section 270 (Step 7), the control section 200 operates to perform a printing job (Step S8).

As above, in the image forming system 100 according to the first embodiment, the information acquisition section 208 of the image forming apparatus 10 is operable to analyze information provided from the information providing section 30 of the toner container 20 in the state of being mounted on the toner-container mounting section 11 so as to acquire toner-quality information indicative of quality of the toner 22 contained in the toner container 20 in the state of being mounted on the toner-container mounting section 11. Then, the control section 200 is operable to identify quality of the toner 22 based on the toner-quality information acquired by the information acquisition section 208, and set a printing function based on the identified quality, to the printing-data producing section 210. This makes it possible to set a printing function suitable for toner quality so as to adequately perform a printing job depending on toner quality.

In addition, when the information acquisition section 280 cannot acquire requested information from the toner container 20 in the state of being mounted on the toner-container mounting section 11, the control section 200 of the image forming apparatus 10 is operable to set a relatively low printing function to the printing-data producing section 210, so as to prevent occurrence of deterioration in image quality and malfunction of the image forming apparatus 10.

For example, a factor having an impact on quality of the toner 22 contained in the toner container 20 includes a toner particle size. Image quality becomes higher as the toner particle size is reduced, whereas a production cost becomes lower as the toner particle size is increased. A toner particle size distribution is also one factor having an impact on quality of the toner 22. Specifically, as a rate of a fine particle is excessively increased, the image quality becomes lower, such as occurrence of fogging, whereas the production cost becomes lower. A material of toner includes a resin, a pigment, a colorant, a wax and a surface treatment material, and a general-purpose material is low in quality. A unit cost becomes lower as a sensitivity of a detector to a remaining amount of toner is more roughly set.

Second Embodiment

Figure 7:
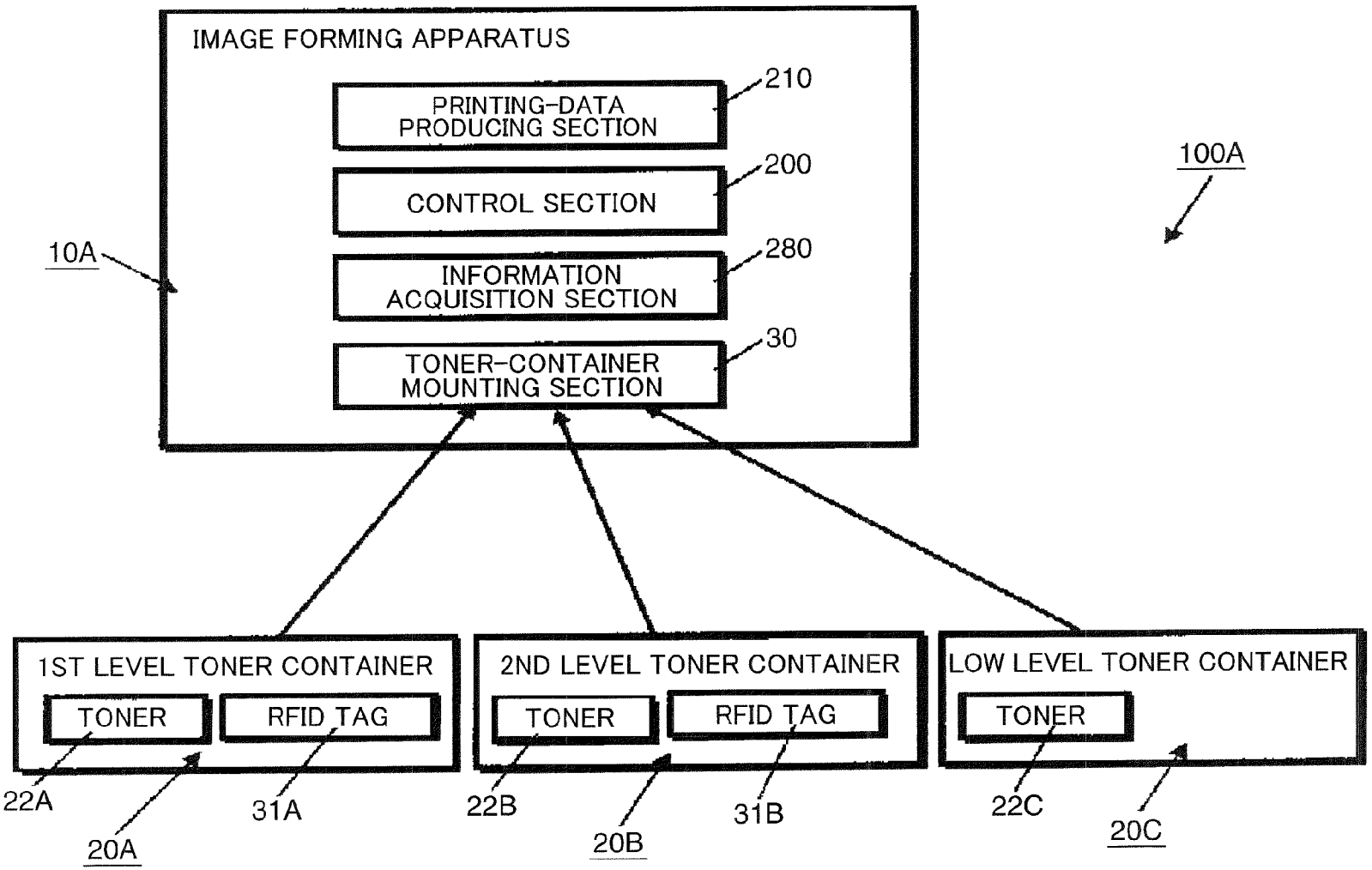
FIG. 7 is a block diagram showing a schematic configuration of an image forming system according to a second embodiment of the present invention.

A second embodiment of the present invention will be described below. An image forming system according to the second embodiment comprises an image forming apparatus, and a plurality of toner containers containing different types of toners different in toner quality adapted to be demountably mounted to the image forming apparatus. FIG. 7 is a block diagram showing a schematic configuration of the image forming system according to the second embodiment.

As shown in FIG. 7, the image forming system 100A according to the second embodiment comprises an image forming apparatus 10A, and a plurality of toner containers 20A, 20B, 20C each adapted to be demountably mounted to the image forming apparatus 10A. The image forming apparatus 10A in the second embodiment has the same structure and configuration as those in the first embodiment illustrated in FIGS. 1 and 2, and their detailed description will be omitted. FIG. 7 shows only a part of the configuration of the image forming apparatus 10A. Although the number of the toner containers in the second embodiment is set at three, it is understood that the number is not limited to three, but the toner containers may be provided in any other suitable plural number, in such a manner that they contain plural types of toners different in toner quality, respectively.

In the image forming system 100A according to the second embodiment, as a toner container to be mounted on a toner-container mounting section 11 of the image forming apparatus 10A, the toner containers 20A, 20B, 20C are designed to contain plural types of toners different in toner quality depending on user's intended purpose, respectively. The toner container 20A contains a toner 22A having a first level of toner quality, and has an RFID tag 31A provided therein to serve as an information providing section 30. In the same manner, the toner container 20B contains a toner 22B having a second level of toner quality, and has an RFID tag 31B provided therein to serve as an information providing section 30. The image forming apparatus 10A includes an information acquisition section 280 adapted to acquire toner-quality information from each of the RFID tags 31A, 31B so as to identify quality of each of the toner 22A and the toner 22B. The toner container 20C contains a toner 22C having a lower level of toner quality than the first and second levels of toner quality. The toner container 20C is provided with no RFID tag. Thus, the image forming apparatus 10A cannot identify the quality of the toner C contained in the toner container 20C. Thus, for example, in use of the toner C, an control section 200 of the image forming apparatus 10A is operable to set a relatively low printing function which allows image quality to be not affected by the quality of the toner 22C, to a printing-data producing section 210.

The control section 200 of the image forming apparatus 10A is operable, based on each of the qualities of the toners 22A, 22B, 22C in the toner containers 20A, 20B, 20C in a state of being mounted in the toner-container mounting section 11, to set a printing function having restrictions placed thereon in terms of a draft mode, a resolution, a smoothing treatment, an indication of a remaining amount of toner, etc., to the printing-data producing section 210, so as to adequately perform a printing job depending on each of the toner qualities.

Thus, a user can selectively use either one of the high-cost, high-level toner containers 20A, 20B and the low-cost, low-level toner container 20C, according to intended purpose. For example, a user who intends to print a large number of sheets without regard to printing quality can use the low-level toner container 20C, and a user who intends to obtain high printing quality or adequately manage components of the image forming apparatus 10A can use each of the toner containers 20A, 20B provided with the information providing sections 30 (RFID tags 31A, 31B). Generally, an unauthorized toner container, such as a pirated toner container, is not provided with the information providing sections 30. Thus, such a toner container will be handled in the same manner as that in the low-level toner container, and a printing function will be restricted. The image forming system 100A according to the second embodiment makes it possible to adequately set a difference in printing job in such a manner that a printing function (resolution, smoothing function, etc.) can be utilized in a wider range as a toner container contains a higher level of toner quality, whereas a printing job using a toner container containing a low level of toner quality can be performed only in a specific function or a predetermined parameter value.

Third Embodiment

Figure 8:
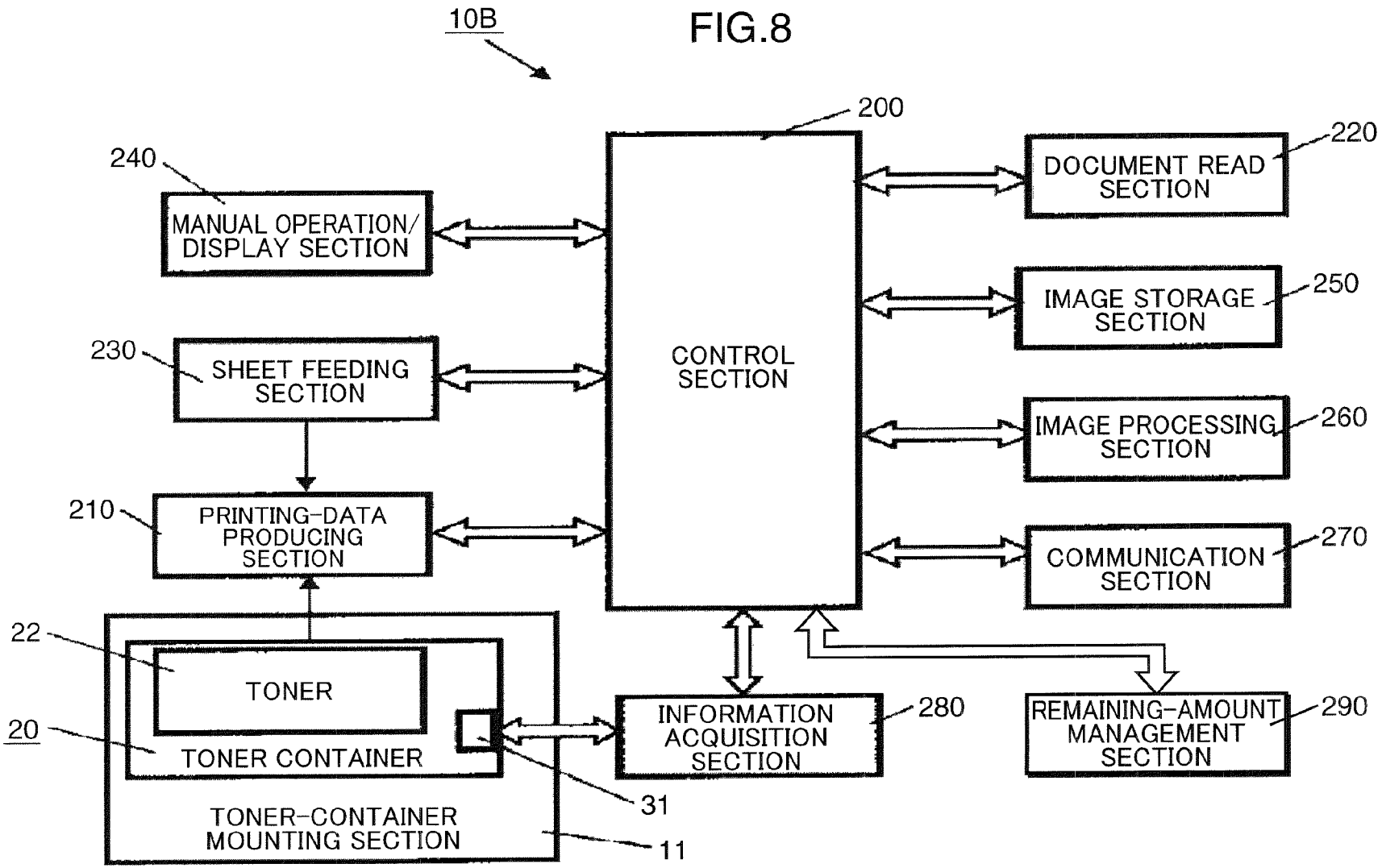
FIG. 8 is a block diagram showing a system configuration of an image forming apparatus in an image forming system according to a third embodiment of the present invention.

A third embodiment of the present invention will be described below. FIG. 8 is a block diagram showing a system configuration of an image forming apparatus in an image forming system according to the third embodiment. The image forming apparatus 10B in the third embodiment comprises a remaining-amount management section 290 in addition to the configuration of image forming apparatus 10 in the first embodiment.

In the image forming system according to the third embodiment, the remaining-amount management section 290 of the image forming apparatus 10B is operable to manage a remaining amount of toner in a toner-container 20 in a state of being mounted on a toner-container mounting section 11, and, at a time when the toner remaining amount becomes zero, inform the fact to a control section 200. Then, the control section 200 is operable, in response to receiving the information, to issue a request for deleting toner-quality information stored in a storage section 313 of an RFID tag 31, to the information acquisition section 280. In response to receiving the request for deletion, the information acquisition section 280 is operable to instruct a control circuit 312 of the RFID tag 31 to delete the toner-quality information stored in the storage section 313 of the RFID tag 31. Then, the control circuit 312 is operable, in response to the instruction, to delete the toner-quality information stored in the storage section 313. Thus, in the toner container 20 where the toner 22 has run out, the toner-quality information stored in the storage section 313 of the RFID tag 31 is deleted. In a recycle process where the toner container 20 demounted from the image forming apparatus 10B is collected by a recycling dealer and reused after being refilled with toner, a printing result is likely to be affected by quality of the new toner, to cause a change in image quality. In the third embodiment, even if the container 20 refilled with the toner is re-mounted to the image forming apparatus 10B, the container 20 will be recognized as a low-level toner container, because the toner-quality information has been deleted in the above manner. This makes it possible to prevent occurrence of deterioration in image quality and malfunction of the image forming apparatus 10B.

While the present invention has been described based on the specific embodiments thereof, it is obvious to those skilled in the art that the present invention is not limited to the specific embodiments, but various changes and modifications may be made therein without departing from the spirit and scope of the present invention. For example, the information providing section 30 and the information acquisition section 280 in the first to third embodiments are made up of the RFID tag and the reader/writer, respectively. Alternatively, the information providing section and the information acquisition section may be made up of a barcode and a barcode reader, respectively.

In view of the above embodiments, the present invention can be summarized as follows. According to a first aspect of the present invention, there is provided an image forming system which comprises an image forming apparatus, and a toner container mountable to the image forming apparatus. The toner container includes an information providing section which provides toner-quality information indicative of quality of a toner contained in the toner container, to the image forming apparatus. The image forming apparatus includes: a toner-container mounting section which allows the toner container to be demountably mounted thereon; an information acquisition section which acquires the toner-quality information about the toner contained in the toner container, from the information providing section of the toner container mounted on the toner-container mounting section; a printing-data producing section which produces printing data; and a control section which controls respective operations of the information acquisition section and the printing-data producing section. The control section is operable, based on the toner-quality information acquired by the information acquisition section, to identify the quality of the toner contained in the toner container and set a printing function based on the identified toner quality, to the printing-data producing section.

In the image forming system of the present invention, quality of a toner contained in the toner container can be identified to set a printing function based on the identified toner quality. This makes it possible to adequately perform a printing job depending on the identified toner quality.

Preferably, in the image forming system of the present invention, the information providing section is a radio frequency identification (RFID) tag having a storage section which stores therein the toner-quality information about the toner contained in the toner container.

According to this feature, the information providing section can acquire the toner-quality information in a wireless and non-contact manner.

Preferably, in the above image forming system, there is further provided a remaining-amount management section which manages a remaining amount of the toner contained in the toner container mounted on the toner-container mounting section, and the control section is operable, when the control section detects, based on a management result from the remaining-amount management section, a time when the remaining amount of the toner contained in the toner container mounted on the toner-container mounting section becomes zero, to delete the toner-quality information stored in the storage section of the RFID tag at the time.

According to this feature, even if the toner container after a remaining amount of toner becomes zero is refilled with unauthorized toner, and reused, quality of the refill toner will never be identified based on the toner-quality information previously stored in the storage section of the RFID tag. This makes it possible to prevent a printing function from being set based on an improper recognition that quality of the refill toner is identical to quality of authorized toner.

Preferably, in the image forming system of the present invention, the control section is operable, when the information acquisition section fails to acquire the toner-quality information about toner contained in the toner container mounted on the toner-container mounting section, to set a predetermined printing function to the printing-data producing section, regardless of the quality of the toner contained in the toner container.

According to this feature, even when quality of the toner cannot be identified, a predetermined printing function will be set to allow a printing job to be adequately performed regardless of quality of the toner.

According to a second aspect of the present invention, there is provided an image forming apparatus designed to allow a toner container including an information providing section which provides toner-quality information indicative of quality of a toner contained in the toner container, to be mounted thereto. The image forming apparatus comprises: a toner-container mounting section which allows the toner container to be demountably mounted thereon; an information acquisition section which acquires the toner-quality information about the toner contained in the toner container, from the information providing section of the toner container mounted on the toner-container mounting section; a printing-data producing section which produces printing data; and a control section which controls respective operations of the information acquisition section and the printing-data producing section. The control section is operable, based on the toner-quality information acquired by the information acquisition section, to identify the quality of the toner contained in the toner container and set a printing function based on the identified toner quality, to the printing-data producing section.

In the image forming apparatus of the present invention, quality of a toner contained in the toner container can be identified to set a printing function based on the identified toner quality. This makes it possible to adequately perform a printing job depending on the identified toner quality.

According to a third aspect of the present invention, there is provided a method for setting a printing function for an image forming system, which comprises step (a) of acquiring toner-quality information indicative of quality of a toner contained in a toner container which is mounted to an image forming apparatus, step (b) of identifying the quality of the toner contained in the toner container, based on the toner-quality information acquired in step (a), and setting a printing function based on the identified toner quality, and step (c) of performing a printing job according to the printing function set in step (b).

In the method of the present invention, quality of a toner contained in the toner container can be identified to set a printing function based on the identified toner quality. This makes it possible to adequately perform a printing job depending on the identified toner quality Preferably, in the method of the present invention, in step (b), in response to a failure to acquire the toner-quality information in step (a), a predetermined printing function is set, regardless of the quality of the toner contained in the toner container.

According to this feature, even when quality of the toner cannot be identified, a predetermined printing function will be set to allow a printing job to be adequately performed regardless of quality of the toner.

This application is based on Japanese Patent Application Serial No. 2007-002583 filed in Japan Patent Office on Jan. 10, 2007, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming system comprising:

an image forming apparatus; and a toner container mountable to the image forming apparatus, the toner container including an information providing section which provides toner-quality information indicative of quality of a toner contained in the toner container, to the image forming apparatus, said information providing section having a storage section that stores therein the toner-quality information about the toner contained in the toner container, the image forming apparatus includes:

a toner-container mounting section which allows the toner container to be demountably mounted thereon;

an information acquisition section which acquires the toner-quality information about the toner contained in the toner container, from the information providing section of the toner container mounted on the toner-container mounting section;

a printing-data producing section which produces printing data;

a control section which controls respective operations of the information acquisition section and the printing-data producing section, the control section being operable, based on the toner-quality information acquired by the information acquisition section, to identify the quality of the toner contained in the toner container and set a printing function based on the identified toner quality, to the printing-data producing section; and a remaining-amount management section which manages a remaining amount of the toner contained in the toner container on the toner-container mounting section, wherein upon detecting based on a management result from the toner-container mounting section that the remaining amount of the toner contained in the toner container mounted on the toner-container mounting section becomes zero, the control section is operable to delete the toner-quality information stored in the storing section at the time, and wherein, when the information acquisition section fails to acquire the toner-quality information about toner contained in the toner container mounted on the toner-container mounting section, the control section is operable to set to the printing-data producing section, a printing function that is lower than that of the case where the information acquisition section acquires the toner-quality information, regardless of the quality of the toner contained in the toner container.

2. The image forming system of claim 1, wherein the information providing section is a radio frequency identification (RFID) tag having said storage section.

3. A method for setting a printing function for an image forming system, comprising the steps of:

(a) acquiring toner-quality information indicative of quality of a toner contained in a toner container which is mounted to an image forming apparatus;

(b) identifying the quality of the toner contained in the toner container, based on the toner-quality information acquired in step (a), and setting a printing function based on the identified toner quality; and (c) performing a printing job according to the printing function set in step (b)

wherein said step (a) includes the steps of storing in a storage section the toner-quality information about the toner contained in the toner container, and detecting a remaining amount of the toner contained in the toner container, and upon detecting that the remaining amount of the toner contained in the toner container mounted on the toner-container mounting section becomes zero in said step (a), the toner-quality information stored in the storage section is deleted, wherein in said step (b), in response to a failure to acquire the toner-quality information in said step (a), a printing function is set from a narrower range than the range for the printing function when the toner-quality information is acquired, regardless of the quality of the toner contained in the toner container.

4. The method of claim 3, wherein, in step (b), in response to a failure to acquire the toner-quality information in step (a), a printing function, that is lower than that of the case where the toner-quality information is acquired, is set, regardless of the quality of the toner contained in the toner container.

5. An image forming system, comprising:

an image forming apparatus; and a toner container mountable to the image forming apparatus, the toner container including an information providing section which provides toner-quality information indicative of quality of a toner contained in the toner container, to the image forming apparatus, said information providing section having a storage section that stores therein the toner-quality information about the toner contained in the toner container, the image forming apparatus includes:

a toner-container mounting section which allows the toner container to be demountably mounted thereon;

an information acquisition section which acquires the toner-quality information about the toner contained in the toner container, from the information providing section of the toner container mounted on the toner-container mounting section;

a printing-data producing section which produces printing data;

a control section which controls respective operations of the information acquisition section and the printing-data producing section, the control section being operable, based on the toner-quality information acquired by the information acquisition section, to identify the quality of the toner contained in the toner container and set a printing function based on the identified toner quality, to the printing-data producing section; and a remaining-amount management section which manages a remaining amount of the toner contained in the toner container on the toner-container mounting section, wherein upon detecting based on a management result from the toner-container mounting section that the remaining amount of the toner contained in the toner container mounted on the toner-container mounting section becomes zero, the control section is operable to delete the toner-quality information stored in the storing section at the time, and wherein when the information acquisition section fails to acquire the toner-quality information about toner contained in the toner container mounted on the toner-container mounting section, the control section is operable to set to the printing-data producing section, a printing function from a narrower range than the range for the printing function when the information acquisition section acquires the toner-quality information, regardless of the quality of the toner contained in the toner container.

6. The image forming system of claim 5, wherein the information providing section is a radio frequency identification (RFID) tag having said storage section.

7. An image forming apparatus designed to allow a toner container including an information providing section which provides toner-quality information indicative of quality of a toner contained in the toner container, to be mounted thereto and which has a storage section for storing therein the toner-quality information about the toner contained in the toner container, the image forming apparatus comprising:

a toner-container mounting section which allows the toner container to be demountably mounted thereon;

an information acquisition section which acquires the toner-quality information about the toner contained in the toner container, from the information providing section of the toner container mounted on the toner-container mounting section;

a printing-data producing section which produces printing data;

a control section which controls respective operations of the information acquisition section and the printing-data producing section, the control section being operable, based on the toner-quality information acquired by the information acquisition section, to identify the quality of the toner contained in the toner container and set a printing function based on the identified toner quality, to the printing-data producing section; and a remaining-amount management section which manages a remaining amount of the toner contained in the toner container on the toner-container mounting section, wherein upon detecting based on a management result from the toner-container mounting section that the remaining amount of the toner contained in the toner container mounted on the toner-container mounting section becomes zero, the control section is operable to delete the toner-quality information stored in the storage section at the time, and wherein when the information acquisition section fails to acquire the toner-quality information about toner contained in the toner container mounted on the toner-container mounting section, the control section is operable to set to the printing-data producing section, a printing function that is lower than that of the case where the information acquisition section acquires the toner-quality information, regardless of the quality of the toner contained in the toner container.

8. An image forming apparatus designed to allow a toner container including an information providing section which provides toner-quality information indicative of quality of a toner contained in the toner container, to be mounted thereto and which has a storage section for storing therein the toner-quality information about the toner contained in the toner container, the image forming apparatus comprising:

a toner-container mounting section which allows the toner container to be demountably mounted thereon;

an information acquisition section which acquires the toner-quality information about the toner contained in the toner container, from the information providing section of the toner container mounted on the toner-container mounting section;

a printing-data producing section which produces printing data;

a control section which controls respective operations of the information acquisition section and the printing-data producing section, the control section being operable, based on the toner-quality information acquired by the information acquisition section, to identify the quality of the toner contained in the toner container and set a printing function based on the identified toner quality, to the printing-data producing section; and a remaining-amount management section which manages a remaining amount of the toner contained in the toner container on the toner-container mounting section, wherein upon detecting based on a management result from the toner-container mounting section that the remaining amount of the toner contained in the toner container mounted on the toner-container mounting section becomes zero, the control section is operable to delete the toner-quality information stored in the storage section at the time, and wherein when the information acquisition section fails to acquire the toner-quality information about toner contained in the toner container mounted on the toner-container mounting section, the control section is operable to set to the printing-data producing section, a printing function from a narrower range than the range for the printing function when the information acquisition section acquires the toner-quality information, regardless of the quality of the toner contained in the toner container.

* * * * *